US012096829B2

(12) United States Patent
Leith et al.

(10) Patent No.: US 12,096,829 B2
(45) Date of Patent: Sep. 24, 2024

(54) DYNAMICALLY ADJUSTABLE BANDS FOR WEARABLE DEVICES

(71) Applicant: Apple Inc., Cupertino, CA (US)

(72) Inventors: William Leith, San Francisco, CA (US); Camille I. Henrot, San Francisco, CA (US); Donald L. Olmstead, Aptos, CA (US); Jessica J. Lu, Menlo Park, CA (US); John S. Camp, Los Gatos, CA (US); Seul Bi Kim, San Mateo, CA (US); Joseph B. Walker, Campbell, CA (US)

(73) Assignee: Apple Inc., Cupertino, CA (US)

( * ) Notice: Subject to any disclaimer, the term of this patent is extended or adjusted under 35 U.S.C. 154(b) by 180 days.

(21) Appl. No.: 17/849,487

(22) Filed: Jun. 24, 2022

(65) Prior Publication Data

US 2023/0413959 A1 Dec. 28, 2023

(51) Int. Cl.
*A44C 5/00* (2006.01)
*A44C 5/14* (2006.01)

(52) U.S. Cl.
CPC ..... *A44C 5/14* (2013.01)

(58) Field of Classification Search
CPC ... A44C 5/0069; A44C 5/0076; A44C 5/0053; A44C 5/0061; A44C 5/14; G04B 37/1486
USPC ..... 368/282
See application file for complete search history.

(56) References Cited

U.S. PATENT DOCUMENTS 1,140,445 A * 5/1915 Collingwood ..... A44C 5/0061 63/5.1
1,763,929 A * 6/1930 Kellner ..... A45C 11/22 968/300
2,028,791 A * 1/1936 Lynds ..... G04B 37/12 224/174
2,338,332 A * 1/1944 Jaten ..... A44C 5/0076 57/225
2,558,007 A * 6/1951 Smith ..... A44C 5/0069 267/74
2,889,973 A * 6/1959 Muller ..... A44C 5/14 224/168

(Continued)

FOREIGN PATENT DOCUMENTS

FR 2792507 A1 10/2000
KR 20110000416 U 1/2011
WO WO 2016/142262 9/2016

*Primary Examiner* — Jack W Lavinder
(74) *Attorney, Agent, or Firm* — BAKERHOSTETLER

(57) ABSTRACT

Bands for electronic devices, including wearable devices, are designed to dynamically alter their shape (e.g., lengthen) in response to an external force. A band may include one or more interior structures disposed in an exterior structure. The interior structure(s) is/are pulled in tension by the exterior structure. When the interior structure(s) is/are pulled in tension, an additional force (e.g., by a user) that applies tension to the interior structure(s) may cause a relatively small change in tension to the interior structure(s). As a result, the band may appear to provide the same amount to users, despite users having a different wrist size/diameter. A similar phenomenon may occur to a single user when the user's wrist changes in size. Accordingly, based on the interior structure(s) being placed in tension by the exterior structure(s), the force provided by the band may appear constant to users.

20 Claims, 13 Drawing Sheets

(56) References Cited

U.S. PATENT DOCUMENTS

| | | | | | |
|---|---|---|---|---|---|
| 3,063,058 | A * | 11/1962 | Vollet | A44C 5/0069 | 224/175 |
| 3,693,375 | A * | 9/1972 | Paulsen | A44C 5/0069 | 224/175 |
| 4,573,221 | A * | 3/1986 | Hirsch | A44C 5/0053 | 2/338 |
| 4,627,739 | A * | 12/1986 | Shingo | A44C 5/12 | 968/366 |
| 4,757,926 | A * | 7/1988 | Leo | A44C 5/00 | 224/178 |
| 5,823,409 | A * | 10/1998 | Kennedy | A44C 5/22 | 24/301 |
| 7,698,752 | B2 * | 4/2010 | Pennell | A61F 9/027 | 2/452 |
| 9,629,441 | B2 | 4/2017 | Schaller et al. | | |
| 10,455,906 | B1 * | 10/2019 | Wu | A61B 5/6843 | |
| 11,096,455 | B2 | 8/2021 | Douglas | | |
| 11,275,406 | B2 | 3/2022 | Rothkopf et al. | | |

* cited by examiner

DYNAMICALLY ADJUSTABLE BANDS FOR WEARABLE DEVICES

TECHNICAL FIELD

This application is directed to bands for wearable devices, and more particularly, to dynamically adjustable bands that are used to secure wearable devices to users.

BACKGROUND

Wearable devices often include a band used to secure the wearable device to a user. In order to adjust the band to a desired length (corresponding to a diameter for a user's wrist), bands require a user-initiated adjustment. For example, some bands include two separate band portions, with one portion carrying a clasp that can enter one of a number of openings in the other portion of the band, with the different openings accommodating different wrist sizes. In another example, one portion of the band includes an external magnet that can magnetically couple to a magnetically attractable feature(s) on the other portion of the band.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
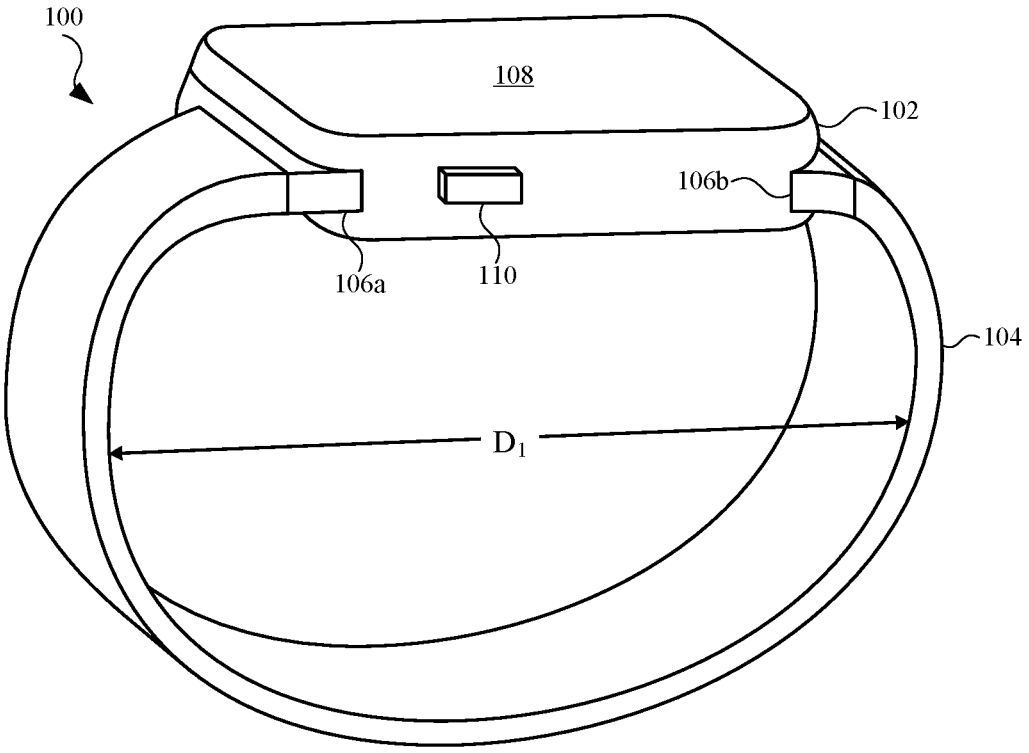
FIG. 1 illustrates a perspective view of an embodiment of an electronic device and a band secured with the electronic device, in accordance with aspects of the present disclosure.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

This disclosure is directed to bands for wearable devices. In particular, the bands described herein are designed to dynamically adjust (e.g., expand and contract) without a user having to manually adjust the band to change the size of the band. Put another way, the diameter of the band may increase or decrease without a user modifying clasps or other external mechanical features. Also, the band is designed to adjust to different users in a manner that provides an appearance of the same force applied to each user, regardless of users with different appendage sizes. The term "appendage" as used in this detailed description and in the claims refers to a user's extremity including, but not limited to, a wrist, a forearm, a bicep, a leg, an ankle, and a shin. Also, while wrist is used throughout this detailed description, it should be noted that "wrist" may be substituted with the aforementioned forms of an appendage.

In some exemplary embodiments, the band includes an exterior structure that encloses an internal structure (or structures). In an initial steady state, the exterior structure applies a force that holds the interior structure(s) in tension. As a result, an additional, external force applied to the band that causes additional tension to the interior structure(s) causes a relatively small amount of change in tension to the interior structure(s). For example, when a user places a wrist through a loop formed by the band, the force provided by the user's wrist results in little change in tension to the interior structure(s) of the band. In another example, when a different user with a larger wrist places the wrist through the loop, the additional force provided by the user's larger wrist may cause the band to expand and increase the diameter of the loop. However, little change in tension to the interior structure(s) occurs. Accordingly, each user may experience the appearance of the same, or substantially similar, force provided by the band.

In another example, some users may experience swelling of a wrist due to physical activity, which increases the force provided to the band. The interior structure(s) may nonetheless undergo little change in tension. In this manner, while the loop formed by the band may increase in diameter to accommodate the swelling wrist, the user may experience the appearance of the same, or substantially similar, force provided by the band.

Based on the interior structure(s), the band may provide a constant force to users despite the users having different wrist sizes. The force may be constant, or appear substantially constant to within ±0.5 Newtons (N) of a given force, through a range of displacement. The range of displacement may include a predetermined or expected range of loop diameters for a given band. Further, bands, including their structural components, may be tuned to provide a force within a desired range of forces, such as a range of approximately 0.5 to 1.5 N.

The interior structure(s) held in tension may include metal structures, including steel structures. Further, some metal structures described herein may be bent or curved in a manner corresponding to the curvature of a loop of a band. These interior structure(s) may be covered by an exterior structure(s) such that the exterior structure(s) pulls the interior structure(s) in tension. Alternatively, the interior structure(s) may include a structure with elastic features, thus allowing the interior structure(s) to expand contract.

Additionally, after the additional force provided by, for example, a user's wrist is removed from the band, the band may return to its initial size and shape. Accordingly, the band is a self-adjusting band that does not require specific user interaction to change the size of the band. Beneficially, the band can dynamically adjust to different users, while providing the appearance to different users of the same force to the user's wrist.

These and other embodiments are discussed below with reference to FIGS. 1-16. However, those skilled in the art will readily appreciate that the detailed description given herein with respect to these Figures is for explanatory purposes only and should not be construed as limiting.

According to some embodiments, for example as shown in FIG. 1, an electronic device 100 is shown in the form of a wearable device, or smartwatch, capable of being worn by a user on a wrist of the user. Electronic device 100 includes a device housing 102 that includes an internal chamber, or internal volume, that stores operational components, such as processors (including a central processing unit and a graphics processing unit), a memory circuit, electronic sensors (e.g., heart rate sensor, blood-oxygen level sensor), and a battery, as non-limiting examples. Device housing 102 may include a metal housing or non-metal housing.

To secure to a user, electronic device 100 may include a band 104 that wraps around a wrist of a user. Band 104 may include one or more of a variety of materials, such as silicone, woven fabric, elastic (or materials with elastically stretchable characteristics), or multiple metal links, as non-limiting examples. As shown in FIG. 1, band 104 can secure with device housing 102 at multiple locations. For example, device housing 102 includes a receptacle 106*a* and a receptacle 106*b*. As shown in FIG. 1, opposing ends of band 104 can secure within receptacles 106*a* and 106*b* of device housing 102. While band 104 is shown as being connected to device housing 102, band 104 can be disconnected with device housing 102 at receptacles 106*a* and 106*b*, and replaced with one or more bands (not shown in FIG. 1). Accordingly, band 104 can be detachably secured with device housing 102.

Electronic device 100 further includes a display 108 designed to present visual information in the form of textual information, still images, or motion images (e.g., video). Display 108 may include a light-emitting diode (LED) display or an organic light-emitting diode (OLED) display, as non-limiting examples. Additionally, display 108 may include a capacitive touch input display, thus allowing display 108 to take the form of a touchscreen to receive an input from a user.

Additionally, electronic device 100 may include input mechanisms designed to provide an input to a processor of electronic device 100, with the input causing the processor to provide a command to alter and update the visual information provided by display 108. For example, electronic device 100 includes an input mechanism 110. In some embodiments, input mechanism 110 includes a button that, when depressed, actuates a switch to generate an input. Alternatively, in some embodiments, input mechanism 110 includes a dial that, when rotated, generates an input, with the input varying based upon clockwise rotation or counterclockwise rotation of input mechanism 110. Although not shown, one or more input mechanisms may be included, each of which may take a form of input mechanism 110 as described herein.

Referring again to band 104, when a respective end of band 104 is secured within receptacles 106*a* and 106*b*, band 104 forms a continuous loop with diameter $D_1$. Traditional bands for wearable devices include multiple, separable components that can be moved relative to each other and coupled together by a clasp to change the diameter of the loop. However, as shown in FIG. 1, band 104 is a continuous, single-piece band. As will be described below, band 104 can dynamically change in diameter.

Figure 2:
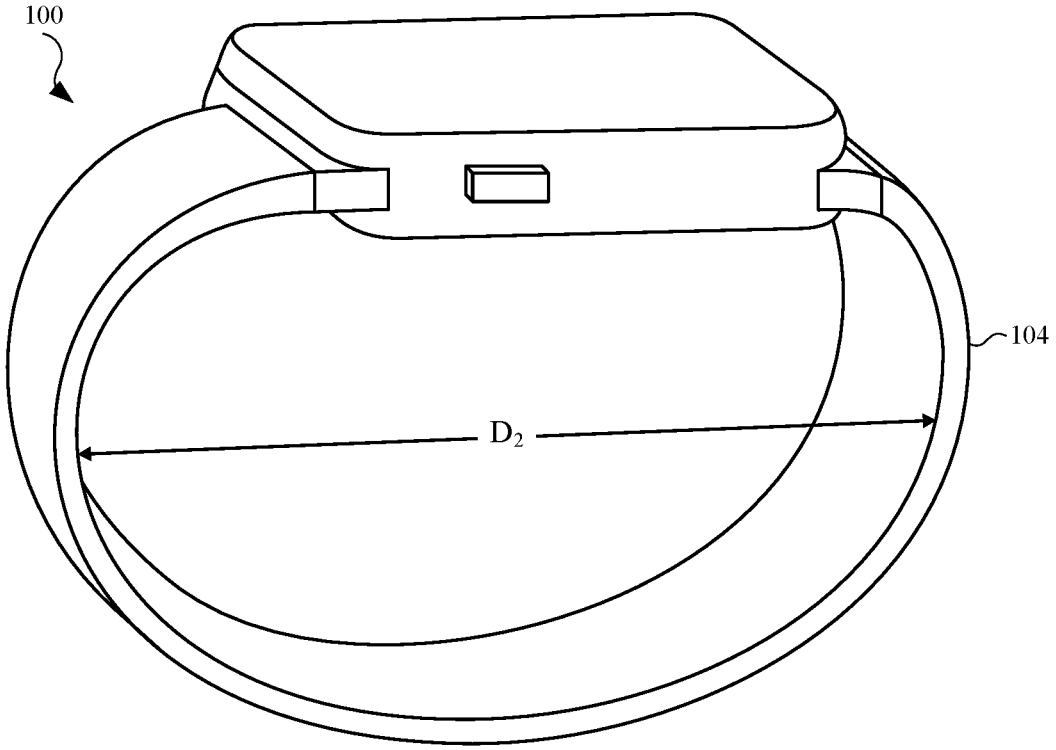
FIG. 2 illustrates a perspective view of an embodiment of the wearable device and the band shown in FIG. 1, further showing a lengthening of the band, in accordance with aspects of the present disclosure.

Referring to FIG. 2, band 104 is elongated and the loop formed by band 104 includes a diameter $D_2$ that is greater than $D_1$ (shown in FIG. 1). The length of band 104 may increase based upon external forces acting on band 104. For example, users with different wrist sizes (i.e., wrist diameters) can wear electronic device 100, causing band 104 to elongate such that the loop formed by band 104 increases to $D_2$. Alternatively, when a user's wrist increases in size, the increased size can cause the loop of band 104 to increase to $D_2$. Still further, the user can cause the loop of band 104 to increase by moving electronic device 100 to a different location on the user (e.g., from wrist to bicep). When the external force acting on band 104 is removed, band 104 can return to its original size and the loop formed by band 104 can return to its original diameter, i.e., diameter $D_1$. While $D_2$ represents a single diameter change from $D_1$, it should be noted that several additional diameters different from $D_2$, and greater than $D_1$, are possible.

Figure 3:
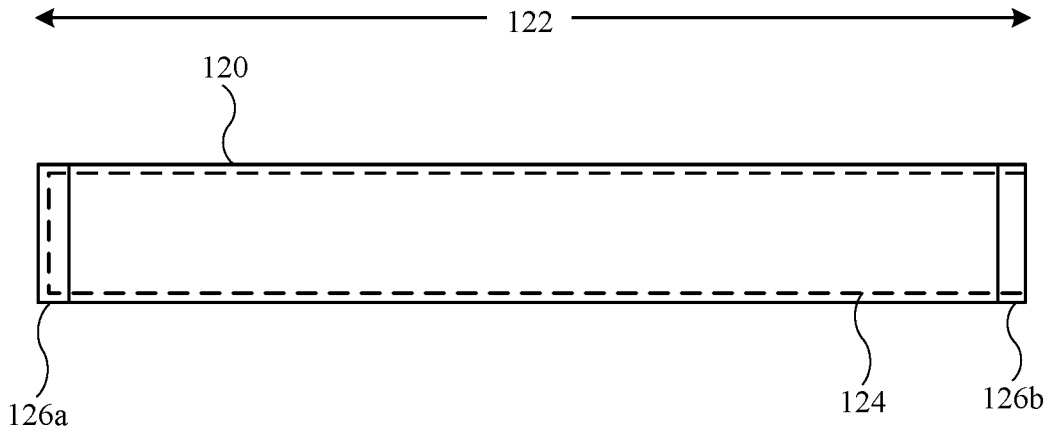
FIG. 3 illustrates a plan view of an exterior structure of a band, in accordance with aspects of the present disclosure.
Figure 4:
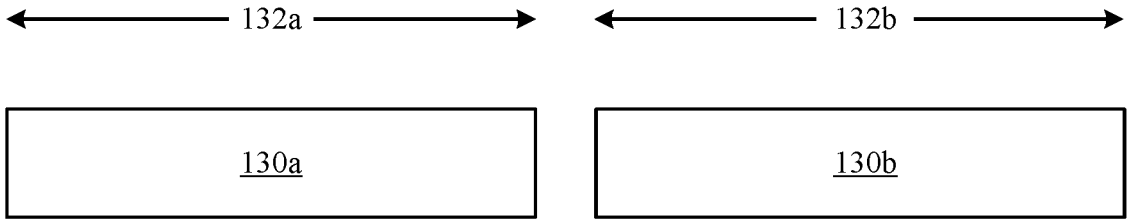
FIG. 4 illustrates a plan view of an interior structure of a band, in accordance with aspects of the present disclosure.

FIGS. 3 and 4 show various structures for band 104 (shown in FIGS. 1 and 2). Referring to FIG. 3, a structural member 120 for band 104 is shown. While structural member 120 includes a rectangular shape, other shapes are possible. As shown in FIG. 3, structural member 120 includes a dimension 122, representing a one-dimensional length of structural member 120. Also, dimension 122 represents a steady-state length of structural member 120. Put another way, dimension 122 of structural member 120 represents a length when no other external forces are acting upon structural member 120, with the exception of gravitational forces.

In some embodiments, structural member 120 includes one or more textile materials. For example, structural member 120 may include one or more fabrics, or one or more yarns, as non-limiting examples. Alternatively, or additionally, structural member 120 may further include elastic (or an elastically stretchable material), polymers, leather, metal, or some combination thereof. Moreover, the selected material(s) may be knitted or woven together to form structural member 120. Generally, structural member 120 may include any material(s) with elastically compressible properties, thus allowing structural member 120 to change (e.g., decrease) its length to a length less than dimension 122 when a force(s) is/are acting upon structural member 120, while also allowing structural member 120 to return to its original, uncompressed length (i.e., dimension 122) when the force(s) is/are removed.

As shown in FIG. 3, structural member 120 includes an internal chamber 124 (shown as a dotted line) designed to receive and enclose another structural member(s) of band 104. Internal chamber 124 represents a three-dimensional void or space within structural member 120. In this regard, internal chamber 124 may be referred to as a sleeve or a pocket.

Also, structural member 120 may include an end 126*a* and end 126*b*, representing opposing ends of structural member 120. Ends 126*a* and 126*b* may be referred to as a first end and a second end, respectively. However, "first" and "second" may be interchanged.

Referring to FIG. 4, structural members 130*a* and 130*b* for band 104 are shown. While structural members 130*a* and 130*b* each includes a rectangular shape, other shapes are possible. For example, structural members 130*a* and 130*b* may each take the form of a cylindrical shape. When band 104 is assembled, structural members 130*a* and 130*b* may be disposed in internal chamber 124 of structural member 120 (shown in FIG. 3).

As shown in FIG. 4, structural members 130*a* and 130*b* include a dimension 132*a* and a dimension 132*b*, respectively. Dimensions 132*a* and 132*b* represent a one-dimensional length of structural members 130*a* and 130*b*, respectively. Also, dimensions 132*a* and 132*b* represent a steady-state length of structural members 130*a* and 130*b*, respectively. Put another way, dimension 132*a* and dimension 132*a* represent a length of structural member 130*a* and structural member 130*a*, respectively, when no other external forces are acting upon structural members 130*a* and 130*b*, with the exception of gravitational forces.

In some embodiments, structural members 130*a* and 130*b* include a metal, such as steel. However, in some embodiments, structural members 130*a* and 130*b* each includes a material(s) with elastically stretchable properties, thus allowing structural members 130*a* and 130*b* to change (e.g., increase) their length to a length greater than that of dimension 132*a* and dimension 132*b*, respectively, when acted upon by an external force(s). When the external force(s) is/are removed, structural members 130*a* and 130*b* subsequently return to their original length (i.e., dimensions 132*a* and 132*b*).

Figure 5:
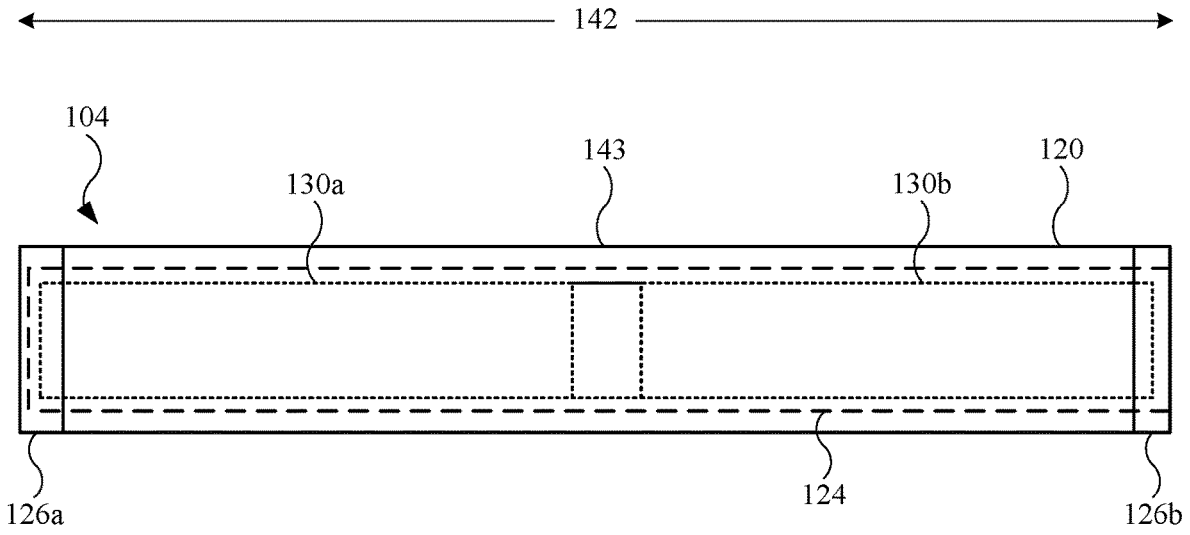
FIG. 5 illustrates a plan view of a band formed from an exterior structure and an interior structure disposed in the exterior structure, in accordance with aspects of the present disclosure.

Referring to FIG. 5, band 104 is assembled with structural members 130*a* and 130*b* positioned within internal chamber 124 of structural member 120. Accordingly, structural member 120 may be referred to as an outer structural member or exterior structural member, and structural members 130*a* and 130*b* may be referred to as inner structural members or interior structural members. Further, when structural member 120 is formed from a fabric-based material, structural member 120 may be referred to as a fabric cover. While structural members 120, 130*a* and 130*b* are shown as flat or planar, the structures may be bent or curved to secure with an electronic device (e.g., electronic device 100 shown in FIGS. 1 and 2). Structural member 130*a* and 130*b* each include an end region, or simply an end, that is fixed in an end of structural member 120. As shown, structural member 130*a* includes an end that is fixed with end 126*a* and structural member 130*b* includes an end that is fixed with end 126*b*. Also, ends 126*a* and 126*b* of structural member 120 may take the form of ends for band 104 when band 104 is assembled.

As shown in FIG. 5, structural members 130*a* and 130*b* may overlap based on their respective dimensions. Additionally, when disposed in structural member 120, structural members 130*a* and 130*b* may be under tension based on a pulling force applied by structural member 120. This may occur when band 104 is secured with an electronic device. Additionally, while structural members 130*a* and 130*b* are under tension by structural member 120, structural members 130*a* and 130*b* may apply a compression force to structural member 120, causing at least some reduction in a dimension of structural member 120. For example, as shown in FIG. 5, structural member 120 undergoes compression and reduces to a dimension 142 that is less than dimension 122 (shown in FIG. 3). The compression of structural member 120 may bias ends 126*a* and 126*b* to toward a central portion 143 located between ends 126*a* and 126*b*.

Figure 6:
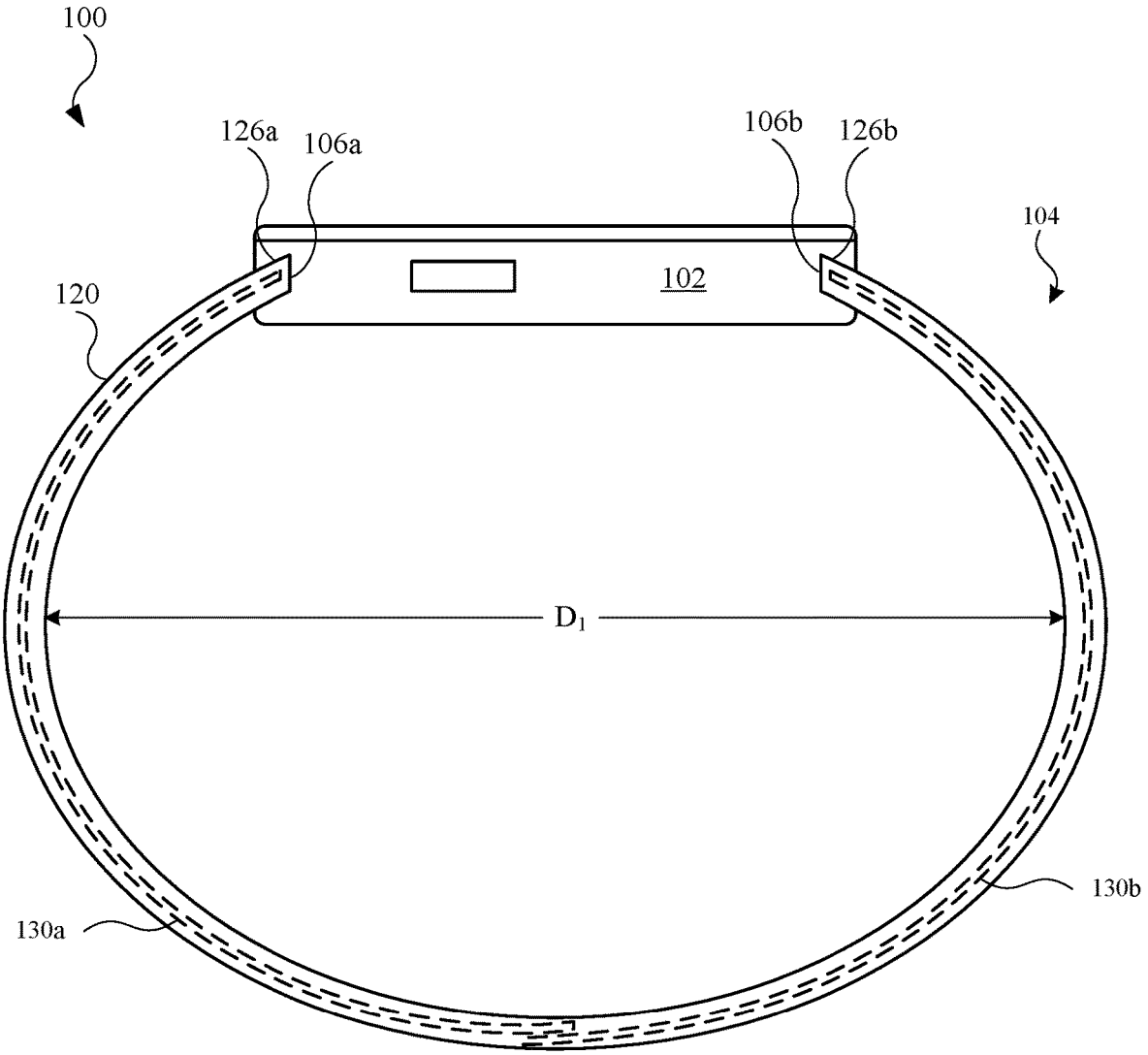
FIG. 6 illustrates a side view of an electronic device and a band secured with the electronic device, showing the band with an interior and exterior structures, in accordance with aspects of the present disclosure.

Referring to FIG. 6, band 104 is assembled with device housing 102. For example, ends 126*a* and 126*b* are secured within receptacles 106*a* and 106*b*, respectively, of device housing 102. Based on an end of structural members 130*a* and 130*b* being positioned in ends 126*a* and 126*b*, respectively, an end of structural members 130*a* and 130*b* is also secured within receptacles 106*a* and 106*b*, respectively.

As shown in FIG. 6, structural members 130*a* and 130*b* are curved structural members. Structural member 120 applies a force that places structural members 130*a* and 130*b* in tension. Structural members 130*a* and 130*b* may each provide a counterforce or counterbalance, which is a function of a spring constant of structural members 130*a* and 130*b*. Accordingly, each of structural members 130*a* and 130*b* may be referred to as a spring element. Simultaneously, structural members 130*a* and 130*b* combine to apply a force that compresses structural member 120. Without other forces acting on structural members 120, 130*a*, and 130*b*, band 104 forms a loop with diameter $D_1$.

At a steady state condition, band 104 forms a loop with diameter $D_1$. In this regard, diameter $D_1$ is an expected diameter of the loop of band 104 when structural member 120 provides a force to structural members 130*a* and 130*b*, and structural members 130*a* and 130*b* provide a force to structural member 120, and no other external force(s) is/are applied with the exception of gravitational forces. When an external force is applied to band 104, band 104 may lengthen, causing the loop to lengthen to a diameter greater than diameter $D_1$. However, due in part to structural member 120 placing structural members 130*a* and 130*b* in tension, additional tension provided by an external force (i.e., a force other than the tension provided by structural member 120) to structural members 130*a* and 130*b* results in a relatively small change in tension to structural members 130*a* and 130*b*. For example, different users having different wrist sizes may wear electronic device 100 and apply different degrees of tension to structural members 130*a* and 130*b*. In another example, a user may wish to move electronic device 100, including band 104, from the wrist do a different extremity (e.g., forearm, bicep, or leg) having a larger diameter than that of the wrist. However, each of the users may experience a similar feel (i.e., similar force) provided by band 104 when wearing electronic device 100, due in part to the relatively small change in tension to structural members 130*a* and 130*b*, regardless of the different applied tension from different users. In another example, a user wearing electronic device 100 may undergo physical activity, causing the user's wrist to swell and increase in diameter.

While this may cause band 104 to expand to a diameter greater than diameter $D_1$, the relatively small change in tension to structural members 130*a* and 130*b* may cause the user to feel the same force applied by band 104 to the user. Accordingly, structural members 130*a* and 130*b*, when placed in tension by structural member 120, provide a counterforce that appears constant, or approximately constant, to a user (or users) for a given range of displacement of band 104. An example of a given range of displacement may include a predetermined range of wrist sizes/diameters for a variety of users. It should be noted that when the external force providing tension is removed from band 104 (particularly, to structural members 130*a* and 130*b*), the loop formed by band 104 may return to its original diameter, i.e., diameter $D_1$, thus allowing band 104 to dynamically change back to its steady state condition.

Also, as shown in FIG. 6, structural members 130*a* and 130*b* overlap each other. When additional tension is applied to structural members 130*a* and 130*b*, structural members 130*a* and 130*b* may remain overlapped. However, in some embodiments, additional tension by an external force may cause structural members 130*a* and 130*b* to transition from an overlapping configuration shown in FIG. 6 to a non-overlapping configuration, with a transition back to the overlapping configuration when the additional tension is removed.

FIGS. 7-16 show alternate embodiments of bands for electronic devices. The bands shown and described in FIGS. 7-16 may include at least some features previously described for bands.

Figure 7:
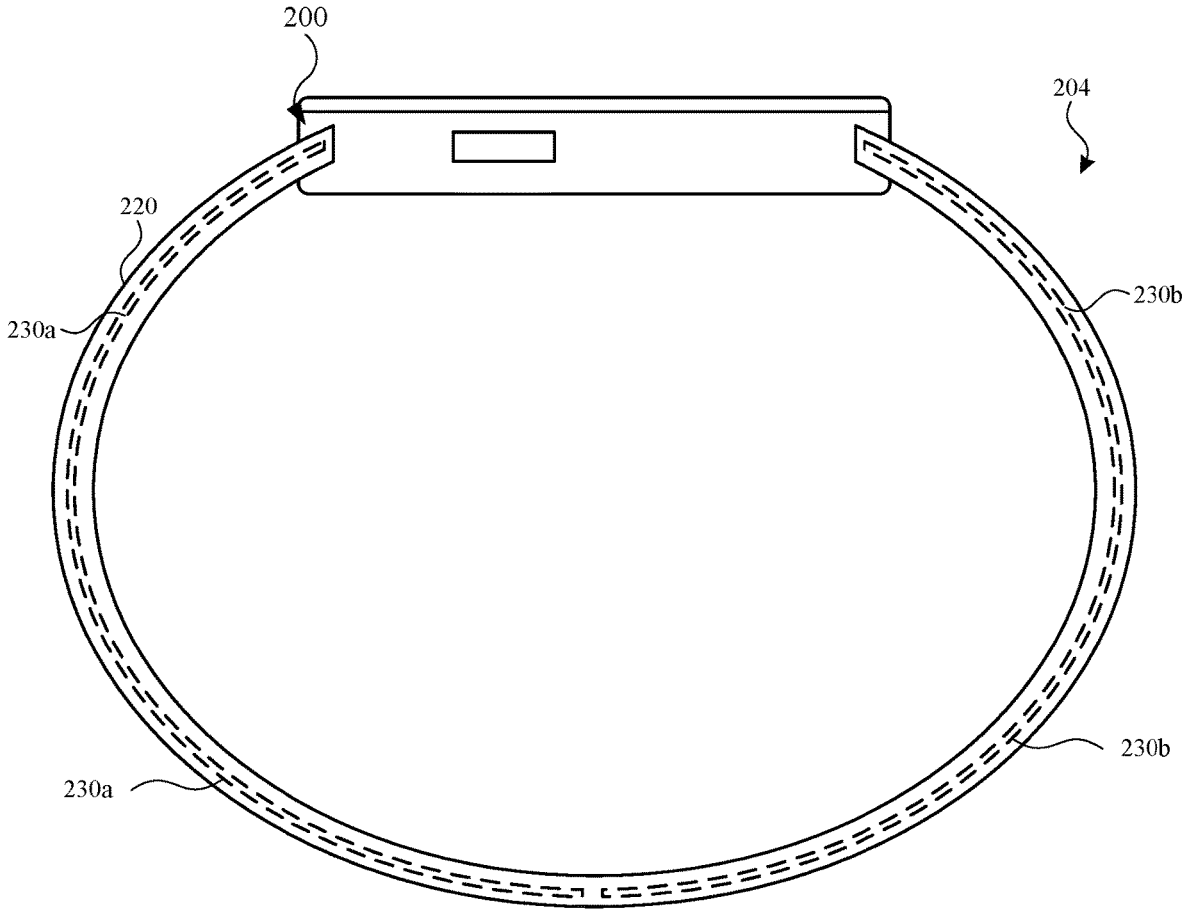
FIGS. 7 and 8 illustrates a side view of an electronic device and a band secured with the electronic device, showing different relationships between interior structures of the band, in accordance with aspects of the present disclosure.

Referring to FIG. 7, an electronic device 200 includes a band 204 with a structural member 220 and structural members 230*a* and 230*b* positioned within structural member 220, with structural members 230*a* and 230*b* in a non-overlapping configuration. Further, band 204 is in a steady-state position with no additional forces acting on band 204 or its components, and structural members 230*a* and 230*b* do not overlap each other. Based on the configuration shown in FIG. 7, structural member 220 applies a force that places structural members 230*a* and 230*b* in tension, and structural members 230*a* and 230*b* provide a force that may provide at least some compression to structural member 220.

Figure 8:
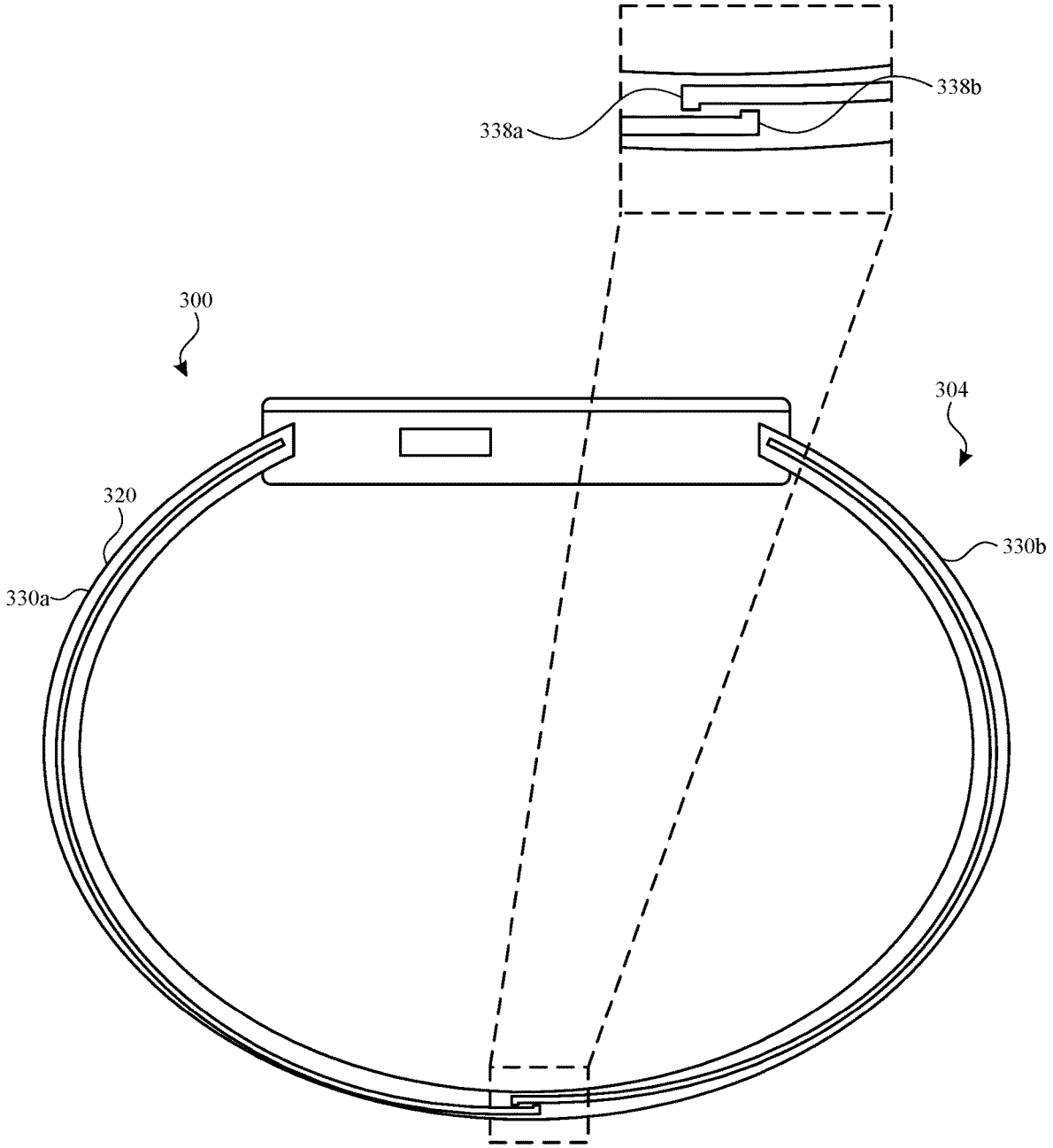

Referring to FIG. 8, an electronic device 300 includes a band 304 with a structural member 320 and structural members 330*a* and 330*b* positioned within structural member 320, with structural members 330*a* and 330*b* having stop mechanisms. Based on the configuration shown in FIG. 8, structural member 320 applies a force that places structural members 330*a* and 330*b* in tension, and structural members 330*a* and 330*b* provide a force that may provide at least some compression to structural member 320. Further, band 304 is in a steady-state position with no additional forces acting on band 304 or its components.

As shown in the enlarged view, structural members 330*a* and 330*b* overlap each other and include a stop mechanism 338*a* and a stop mechanism 338*b*, respectively. In this regard, when an external force is applied to band 304 that would cause band 304 to otherwise displace beyond a predetermine range, structural members 330*a* and 330*b* may move apart from each other such that stop mechanisms 338*a* and 338*b* engage each other, thus preventing further displacement of band 304.

Figure 9:
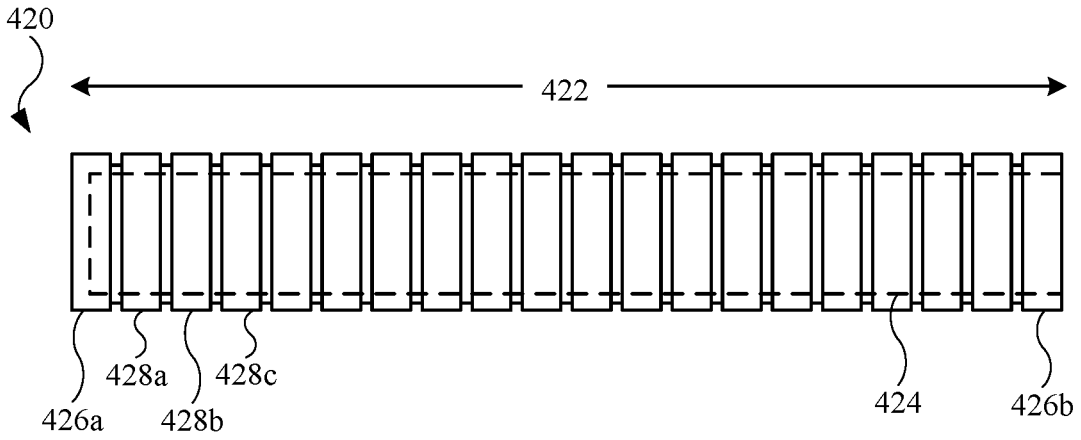
FIG. 9 illustrates a plan view of an alternate exterior structure of a band, in accordance with aspects of the present disclosure.
Figure 10:
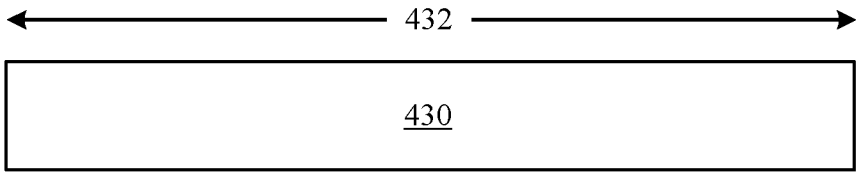
FIG. 10 illustrates a plan view of an alternate interior structure of a band, in accordance with aspects of the present disclosure.

FIGS. 9 and 10 show various structures for one or more bands described herein. Referring to FIG. 9, a structural member 420 for a band is shown. Structural member 420 includes a dimension 422, representing a one-dimensional length of structural member 420. Also, dimension 422 represents a steady-state length of structural member 420. Put another way, dimension 422 of structural member 420 represents a length when no other external forces are acting upon structural member 420, with the exception of gravitational forces.

In some embodiments, structural member 420 includes one or more textile materials. For example, structural member 420 may include one or more fabrics, or one or more yarns, as non-limiting examples. Moreover, the selected material(s) may be knitted or woven together to form structural member 420. Generally, structural member 420 may include any material(s) with elastically compressible properties, thus allowing structural member 420 to change (e.g., decrease) its length to a length less than that of dimension 422 when an external force(s) is/are acting upon structural member 420, while also allowing structural member 420 to return to its original length (i.e., dimension 422) when the external force(s) is/are removed. While structural member 420 includes a rectangular shape, other shapes are possible.

As shown in FIG. 9, structural member 420 may include an internal chamber 424 designed to receive and enclose another structural member(s) of a band. Also, structural member 420 may include an end 426*a* and end 426*b*, representing opposing ends of structural member 420. When structural member 420 is assembled to form a band, ends 426*a* and 426*b* may be used as ends of the band.

Also, structural member 420 includes several discrete elements. For example, structural member 420 includes an element 428*a*, an element 428*b*, and an element 428*c*. Elements 428*a*, 428*b*, and 428*c* (representative of several additional elements of structural member 420) may include fabric elements, yarn elements, or the like.

Referring to FIG. 10, a structural member 430 for a band is shown. Structural member 430 may include one or more materials. While structural member 430 includes a rectangular shape, other shapes are possible. For example, structural member 430 may take the form of a cylindrical shape. When a band is assembled, structural member 430 may be disposed in internal chamber 424 of structural member 420 (shown in FIG. 9).

As shown in FIG. 10, structural member 430 includes a dimension 432, representing a one-dimensional length of structural member 430. Also, dimension 432 represents a steady-state length of structural member 430. Put another way, dimension 432 of structural member 430 represents a length when no other external forces are acting upon structural member 430, with the exception of gravitational forces.

In some embodiments, structural member 430 includes an elastic material. Generally, structural member 430 may include any material(s) with elastically stretchable properties, thus allowing structural member 430 to change (e.g., increase) its length to a length greater than that of dimension 432 when an external force(s) is/are acting upon structural member 430, while also allowing structural member 430 to return to its original length (i.e., dimension 432) when the external force(s) is/are removed.

Figure 11:
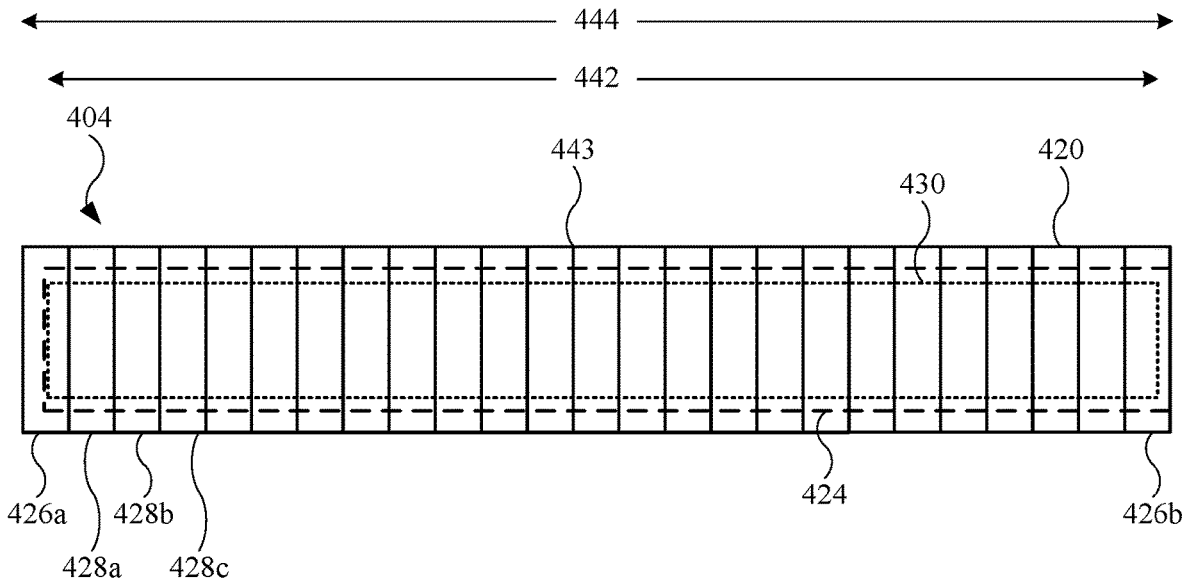
FIG. 11 illustrates a plan view of a band formed from an alternate exterior and interior structures, in accordance with aspects of the present disclosure.

Referring to FIG. 11, a band 404 formed from structural members 420 and 430 is shown. When band 404 is assembled, structural member 430 can be positioned in internal chamber 424 of structural member 420, such that structural member 430 is enclosed by and hidden within structural member 420. In this manner, structural member 430 may be referred to as an inner structural member or interior structural member, and structural member 420 may be referred to as an outer structural member or exterior structural member. Also, structural member 420 and structural member 430 may be referred to as a first structural member and a second structural member, respectively. However, "first" and "second" may be interchanged.

When band 404 is assembled, ends 426*a* and 426*b* may also be used as opposing ends for band 404. Ends 426*a* and 426*b* can be detachably coupled to receptacles of a device housing of an electronic device, thus allowing band 404 to detachably couple from the device housing. Although not explicitly shown, ends 426*a* and 426*b* can be modified to include a shape corresponding to that of the receptacles of the device housing.

Also, an assembly process of band 404 may include securing opposing ends of structural member 430 with ends 426*a* and 426*b*, respectively, of structural member 420, as shown in FIG. 11. By securing opposing ends of structural member 430 to ends 426*a* and 426*b*, structural members 420 and 430 can act on each other to change their respective dimensions. This may occur, for example, when band 404 is secured to a device housing. For example, as a result of a force applied by structural member 420, structural member 430 increases from dimension 422 (shown in FIG. 10) to a dimension 442. Conversely, as a result of a force applied by structural member 430, structural member 420 compresses and decreases from dimension 432 (shown in FIG. 9) to a dimension 444. The compression of structural member 420 may bias ends 426*a* and 426*b* to toward a central portion 443 located between ends 426*a* and 426*b*. Accordingly, structural member 420 provides a force that elongates structural member 430 and places structural member 430 in tension, while simultaneously, structural member 430 provides a force that compresses structural member 420, thus reducing the length of structural member 420.

Regarding structural member 420, FIG. 11 shows adjacent elements of structural member 420 engaging each other based on the compression force provided by structural member 430. For example, elements 428*a* and 428*b* engage each other, and elements 428*b* and 428*c* engage each other. Based upon the force provided by structural member 430 and the material makeup of elements 428*a*, 428*b*, and 428*c*, the elements 428*a*, 428*b*, and 428*c* may individually compress and reduce in size, and the reduce of structural member 420 may be attributed to the individual compressions of elements 428*a*, 428*b*, and 428*c*. Additionally, the engagement by the adjacent elements of structural member 420 provides at least some of the force that maintains tension (e.g., the pulling force) that expands structural member 430.

Figure 12:
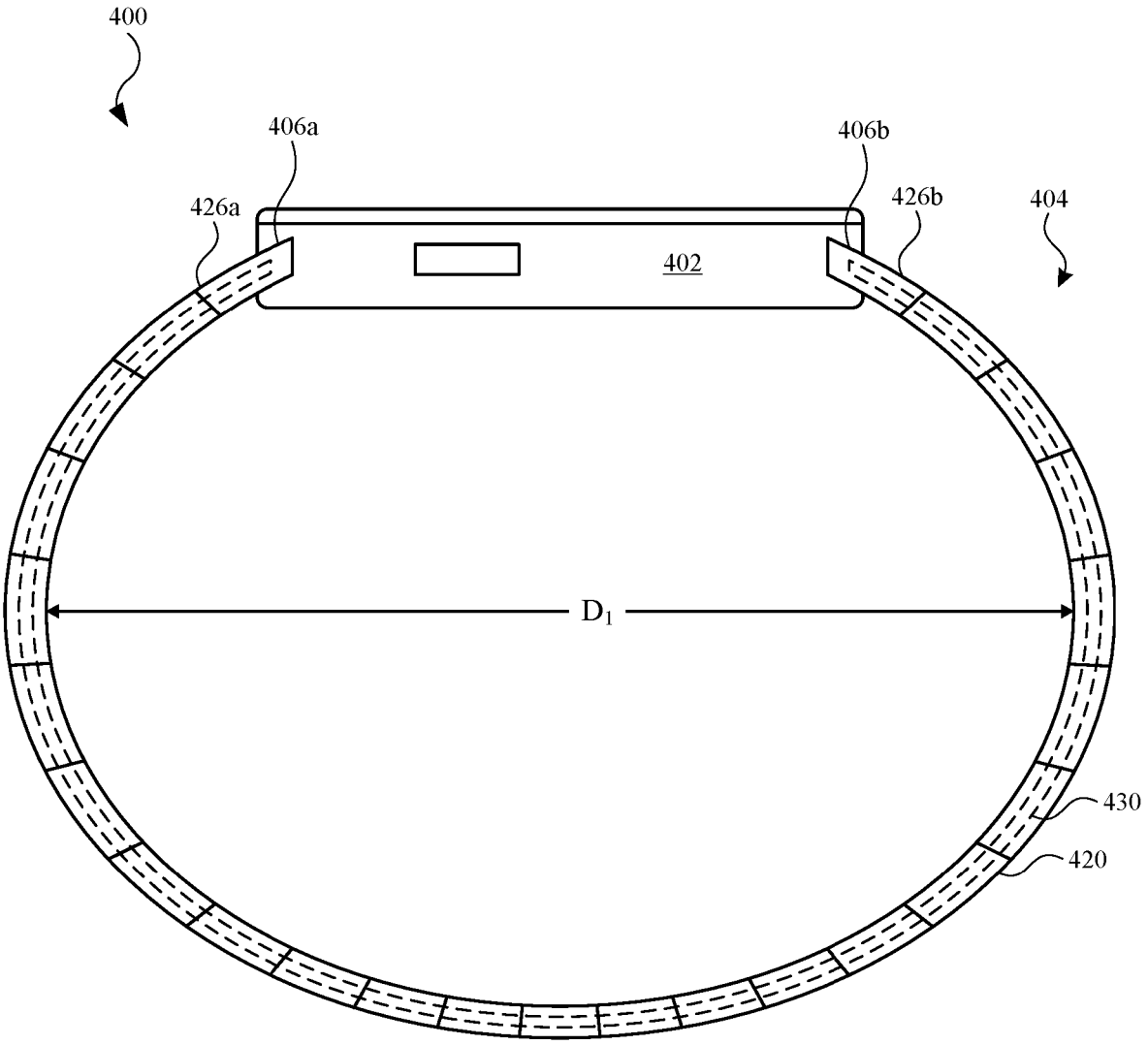
FIG. 12 illustrates a side view of an electronic device and a band secured with the electronic device, showing the band with the alternate interior and exterior structures, in accordance with aspects of the present disclosure.

Referring to FIG. 12, an electronic device 400 with band 404 is shown. Electronic device 400 may include any feature(s) previously described for an electronic device, including a device housing 402 and receptacles 406*a* and 406*b*. Band 404 is secured with device housing 402 by way of ends 426*a* and 426*b* being positioned in receptacles 406*a* and 406*b*, respectively, of device housing 402.

At a steady state condition, band 404 forms a loop with diameter $D_1$. In this regard, diameter $D_1$ is an expected diameter of the loop of band 404 when structural members 420 and 430 apply their respective forces on each other and no other external force(s) is/are applied, with the exception of gravitational forces. When an external force is applied to band 404, however, band 404 may lengthen, causing the loop to lengthen to a diameter greater than diameter $D_1$. Due in part to structural member 420 placing structural member 430 in tension, additional tension provided by the external force to structural member 430 results in a relatively small change in tension to structural member 430. The additional force that provides tension may be applied by different users with different wrist diameters, or a user with a wrist that changes in diameter during, for example, physical activity. In either event, users may experience a similar feel (i.e., similar force) provided by band 404, due in part to the relatively small change in tension to structural member 430, regardless of varying applied tension from wrists of different sizes. Accordingly, structural member 430, when placed in tension by structural member 420, provides a force that appears constant, or approximately constant, to a user (or users) for a given range of displacement of band 404. It should be noted than when the external force providing tension is removed from band 404 (particularly, to structural member 430), the loop formed by band 404 may return to its original diameter, i.e., diameter $D_1$.

Figure 13:
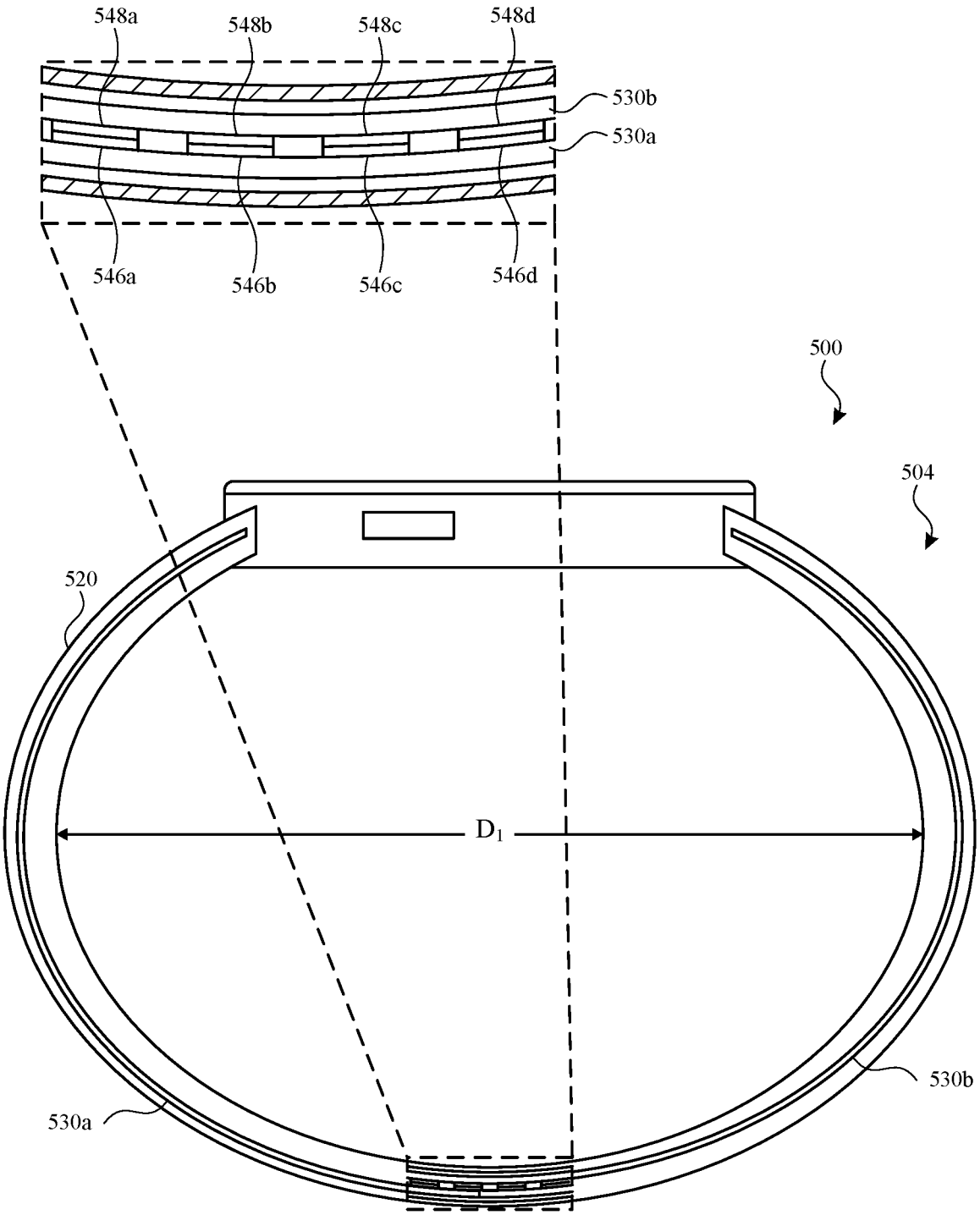
FIGS. 13 and 14 illustrates a side view of an electronic device and a band secured with the electronic device, showing the band with an interior structures that include magnets, in accordance with aspects of the present disclosure.
Figure 14:
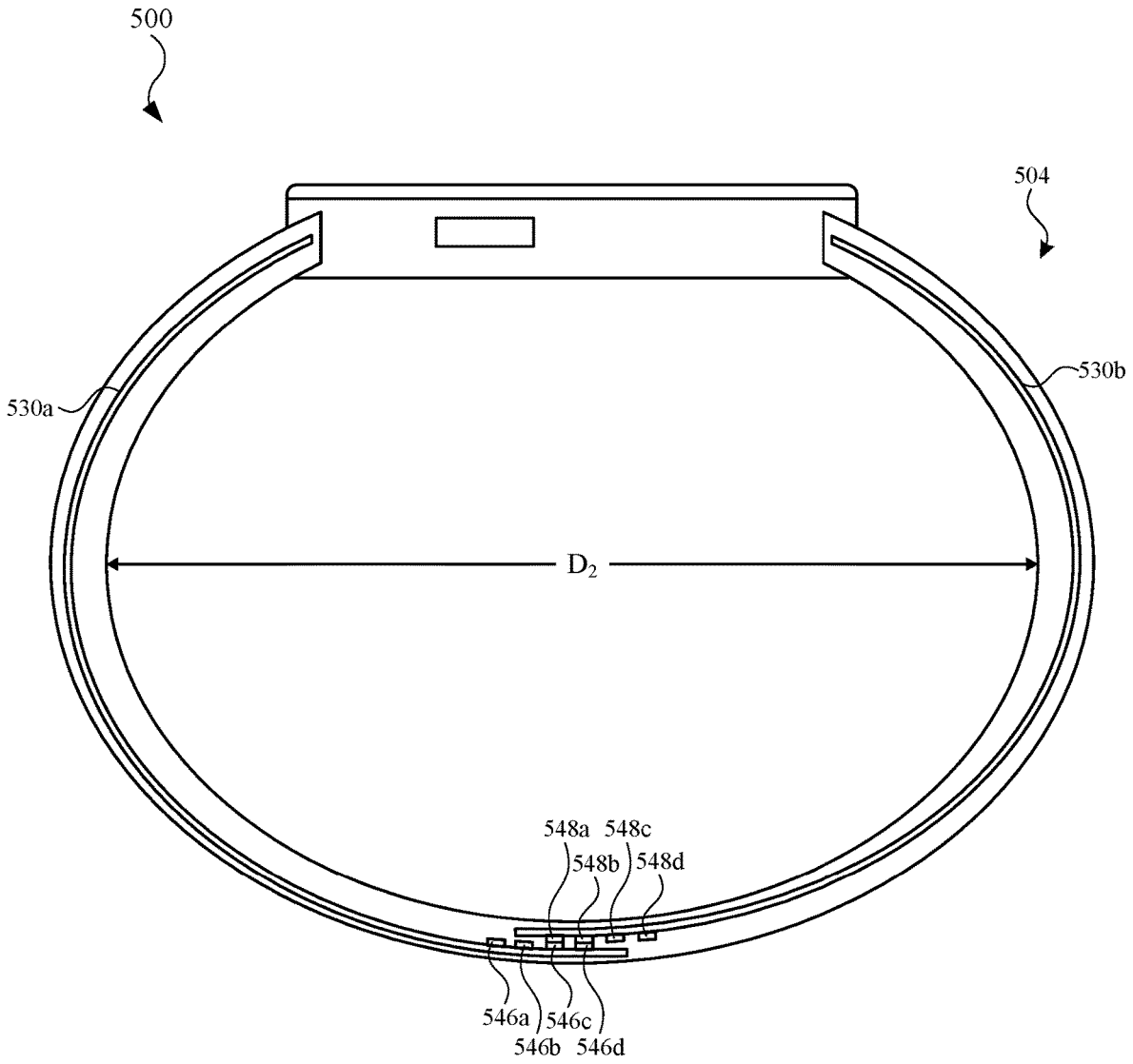

FIGS. 13 and 14 show an electronic device 500 with a band 504 having alternate structural elements. Referring to FIG. 13, electronic device 500 includes a band 504 with a structural element 520 and structural members 530*a* and 530*b* disposed within structural element 520. As shown in the enlarged view, structural members 530*a* and 530*b* include several magnetic elements. For example, structural member 530*a* includes a magnetic element 546*a*, a magnetic element 546*b*, a magnetic element 546*c*, and a magnetic element 546*d*, while structural member 530*b* includes a magnetic element 548*a*, a magnetic element 548*b*, magnetic element 548*b*, and a magnetic element 548*d*. As shown in FIG. 13, magnetic elements 546*a*, 546*b*, 546*c*, and 546*d* of structural member 530*a* are magnetically coupled to magnetic elements 548*a*, 548*b*, 548*c*, and 548*d*, respectively, of structural member 530*b*. The aforementioned magnetic couplings may apply tension to structural members 530*a* and 530*b*, in addition to the tension applied by structural element 520. Alternatively, the aforementioned magnetic couplings may apply virtually all tension to structural members 530*a* and 530*b*, while little or no tension is applied by structural element 520.

At a steady state condition, band 504 forms a loop with diameter $D_1$. However, an external force provided to band 504 may cause band 504 to lengthen such that the looped formed by band 504 increases. Referring to FIG. 14, band 504 forms a loop with a diameter $D_2$ that is greater than diameter $D_1$ (shown in FIG. 13). Based on the increased diameter, at least one of structural members 530*a* and 530*b* may undergo relative movement (e.g., movement away from each other), causing new magnetic couplings between the respective magnetic elements of structural members 530*a* and 530*b*. For example, magnetic elements 546*c* and 546*d* of structural member 530*a* are magnetically coupled to magnetic elements 548*a* and 548*b*, respectively, of structural member 530*b*. The remaining magnetic elements are not magnetically coupled to another magnetic element. The relative movement of structural element 530*a* and/or structural element 530*b* may be provided by a user of electronic device 500. Further, any additional tension provided by an external force (e.g., provided by a user) to structural members 530*a* and 530*b* results in a relatively small change in tension to structural members 530*a* and 530*b*. Additionally, the movement of structural member 530*a* and 530*b*, and subsequent retention by the magnetic couplings, may assist structural members 530*a* and 530*b* in providing a counterforce to maintain an appearance of a constant force to users. It should be noted than when the external force providing tension is removed from band 504 (particularly, to structural members 530*a* and 530*b*), the loop formed by band 504 may return to its original diameter, i.e., diameter $D_1$, and the original magnetic couplings shown in FIG. 13 may again be formed.

Figure 15:
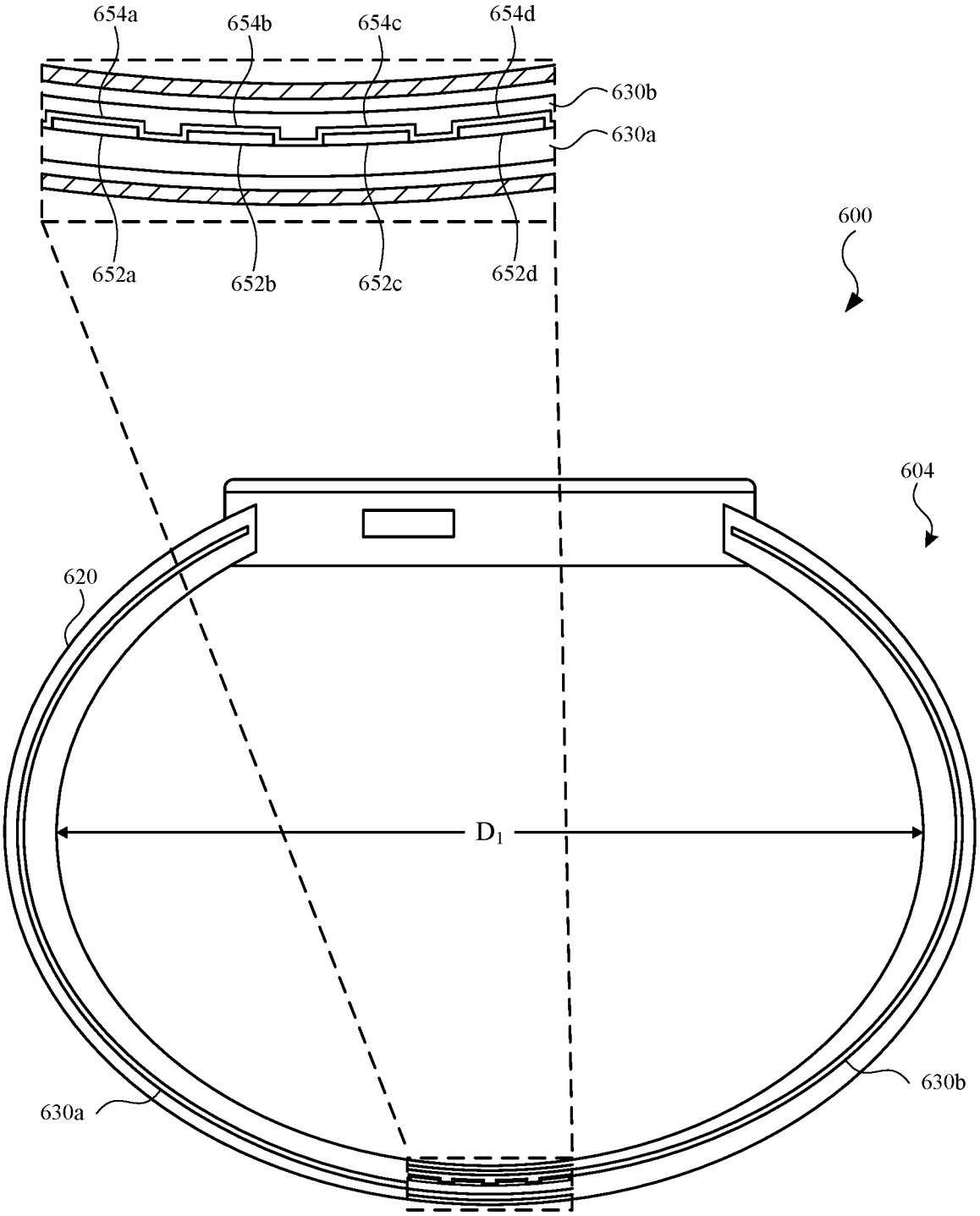
FIGS. 15 and 16 illustrates a side view of an electronic device and a band secured with the electronic device, showing the band with an interior structures that include detents and receptacles, in accordance with aspects of the present disclosure.
Figure 16:
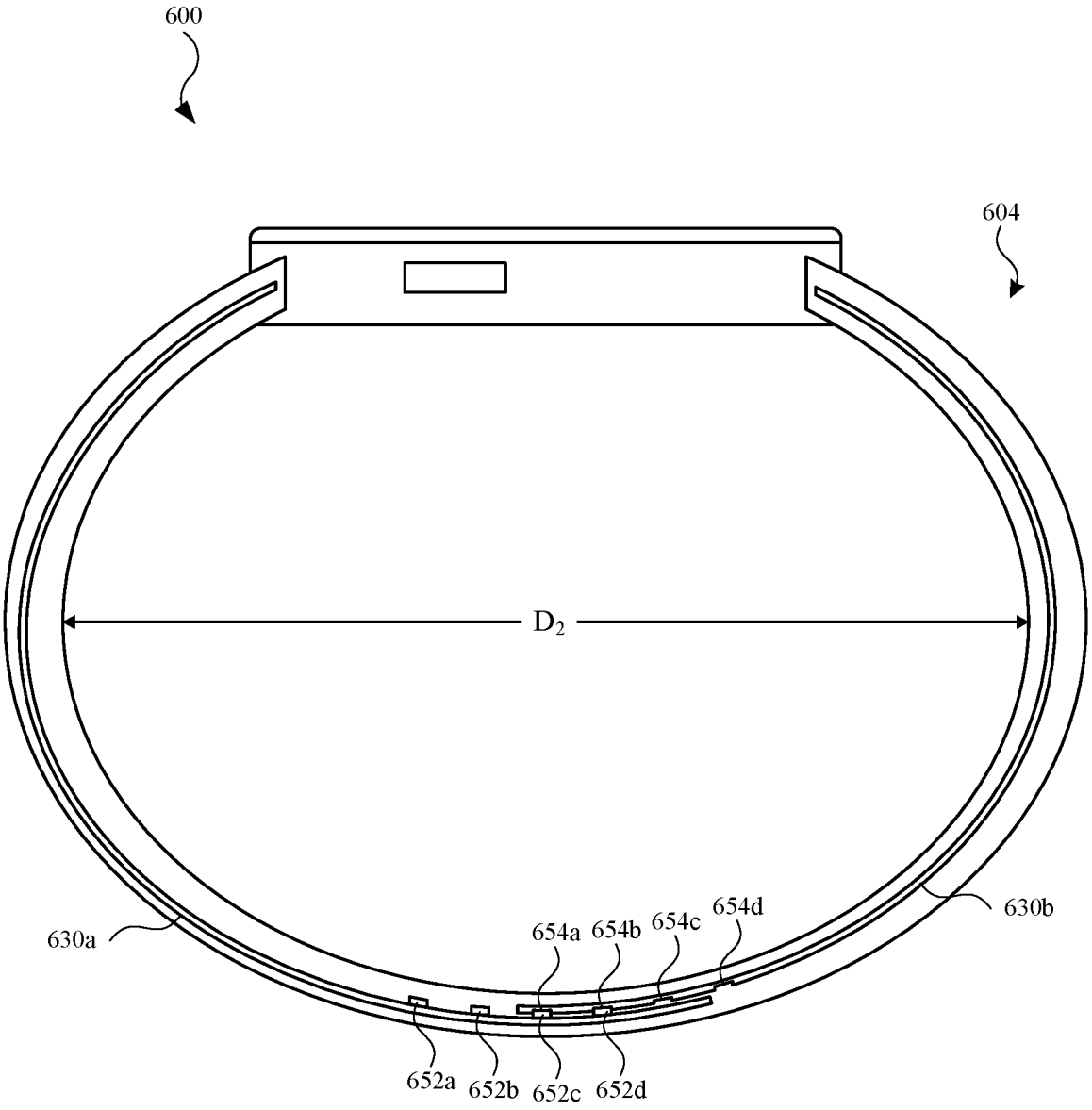

FIGS. 15 and 16 show an electronic device 600 with a band 604 having alternate structural elements. Referring to FIG. 15, electronic device 600 includes a band 604 with a structural element 620 and structural members 630*a* and 630*b* disposed within structural element 620. As shown in the enlarged view, structural members 630*a* and 630*b* include structures coupled together. For example, structural member 630*a* includes a detent 652*a*, detent 652*b*, a detent 652*c*, and a detent 652*d*, while structural member 630*b* includes a receptacle 654*a*, a receptacle 654*b*, a receptacle 654*c*, and a receptacle 654*d*. Further, detents 652*a* 652*b*, 652*c*, and 652*d* of structural member 630*a* are positioned in receptacles 654*a*, 654*b*, 654*c*, and 654*d*, respectively, of structural member 630*b*. The aforementioned couplings may apply tension to structural members 630*a* and 630*b*, in addition to the tension applied by structural element 620. Alternatively, the aforementioned couplings may apply virtually all tension to structural members 630*a* and 630*b*, while little or no tension is applied by structural element 620.

At a steady state condition, band 604 forms a loop with diameter $D_1$. However, an external force provided to band 604 may cause band 604 to lengthen such that the looped formed by band 604 increases. Referring to FIG. 16, band 604 forms a loop with a diameter $D_2$ that is greater than diameter $D_1$ (shown in FIG. 15). Based on the increased diameter, at least one of structural members 630*a* and 630*b* may undergo relative movement (e.g., movement away from each other), causing new couplings between their respective detents and receptacles. For example, detents 652*c* and 652*d* of structural member 630*a* are positioned in receptacles 654*a* and 654*b*, respectively, of structural member 630*b*. Detents 652*a* and 652*b* are no longer positioned in a receptacle. The relative movement of structural element 630*a* and/or structural element 630*b* may be provided by a user of electronic device 600. Further, any additional tension provided by an external force (e.g., provided by a user) to structural members 630*a* and 630*b* results in a relatively small change in tension to structural members 630*a* and 630*b*. Additionally, the movement of structural member 630*a* and 630*b*, and subsequent retention by the detent/receptacle couplings, may assist structural members 630*a* and 630*b* in providing a counterforce to maintain an appearance of a constant force to users. It should be noted than when the external force providing tension is removed from band 604 (particularly, to structural members 630*a* and 630*b*), the loop formed by band 604 may return to its original diameter, i.e., diameter $D_1$, and the original couplings shown in FIG. 15 may again be formed.

Various examples of aspects of the disclosure are described below as clauses for convenience. These are provided as examples, and do not limit the subject technology.

Clause A: A band for a wearable device, the band including: a first structural member that includes an internal chamber, the first structural member further including a first end, a second end opposite the first end, and a central portion between the first end and the second end; and a second structural member positioned in the internal chamber, wherein the second structural member is secured with the first structural member such that the second structural member i) is held in tension by the first structural member and ii) provides a counterforce that biases the first end and the second end toward the central portion.

Clause B: A band for a wearable device, the band including: a fabric cover that forms a first end and a second end opposite the first end, the fabric cover including: a first elastic element, a second elastic element; and a first spring element coupled with the first end; and a second spring element coupled with the second end, wherein the fabric cover pulls the first spring element and the second spring element in tension, and the first elastic element and the second elastic element are compressed based the first spring element and the second spring element.

Clause C: A band for a wearable device, the band including: an exterior structure that includes a sleeve; and an interior structure disposed in the sleeve, wherein the interior structure compresses the sleeve while the exterior structure pulls the interior structure in tension.

One or more of the above clauses can include one or more of the features described below. It is noted that any of the following clauses may be combined in any combination with each other, and placed into a respective independent clause, e.g., clause A, B, or C.

Clause 1: wherein the first structural member includes an assembly, the assembly including: a first element; and a second element that engages the first element based on the counterforce.

Clause 2: wherein: the first structural member includes a fabric, and the second structural member compresses the fabric.

Clause 3: wherein the second structural member expands from a first length to a second length based on the tension provided by the first structural member.

Clause 4: wherein: the first structural member includes a fabric, and the second structural member includes an assembly, the assembly including a first metal structure and a second metal structure.

Clause 5: wherein: the first end is configured to couple with a first receptacle of the wearable device; and the second end is configured to couple with a second receptacle of the wearable device, wherein the first metal structure is secured with the first end, and the second metal structure is secured with the second end.

Clause 6: wherein the first structural member extends continuously from the first end to the second end.

Clause 7: wherein the first metal structure overlaps the second metal structure.

Clause 8: wherein the fabric cover includes a sleeve, and the first spring element and the second spring element are disposed in the sleeve.

Clause 9: wherein the first spring element overlaps with the second spring element.

Clause 10: wherein the first spring element and the second spring element are non-overlapping.

Clause 11: wherein: when the first end is secured in a first receptacle of the wearable device, at least a portion of the first spring element is located in the first receptacle, and when the second end is secured in a second receptacle of the wearable device, at least a portion of the second spring element is located in the second receptacle.

Clause 12: wherein the interior structure includes: a first structural member that carries a first magnet and a second magnet; and a second structural member that carries a third magnet and a fourth magnet, wherein the first structural member and the second structural member are adjustable with respect to each other to transition between a first position and a second position.

Clause 13: wherein: in the first position: the first magnet is magnetically coupled to the third magnet, and the second magnet is magnetically coupled to the fourth magnet, and in the second position: the first magnet is magnetically coupled to the fourth magnet, and the second magnet is magnetically coupled to the third magnet.

Clause 14: wherein: the exterior structure includes a first length in the first position, and the exterior structure includes a second length in the second position, the second length different from the first length.

Clause 15: wherein the interior structure includes: a first structural member that carries a first detent and a second detent; and a second structural member that carries a first receptacle, a second receptacle, and a third receptacle, wherein the first structural member and the second structural member are adjustable with respect to each other to transition between a first position and a second position.

Clause 16: wherein: in the first position: the first detent is located in the first receptacle, and the second detent is located in the second receptacle, and in the second position: the first detent is located in the second receptacle, and the second detent is located in the third receptacle.

Clause 17: wherein the exterior structure includes: a first end; and a second end opposite the first end, wherein the exterior structure extends continuously from the first end to the second end.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The predicate words "configured to", "operable to", and "programmed to" do not imply any particular tangible or intangible modification of a subject, but, rather, are intended to be used interchangeably. In one or more implementations, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration". Any embodiment described herein as "exemplary" or as an "example" is not necessarily to be construed as preferred or advantageous over other embodiments. Furthermore, to the extent that the term "include", "have", or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more". Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. A band for a wearable device, the band comprising:

a first structural member that comprises an internal chamber, the first structural member further comprising a first end, a second end opposite the first end, and a central portion between the first end and the second end; and a second structural member positioned in the internal chamber, wherein the second structural member is secured with the first structural member, wherein in response to the first structural member coupling with the wearable device:

a first force is applied to the second structural member by the first structural member, and a second force is applied to the first structural member by the second structural member, the second force altering the first structural member from a first dimension to a second dimension.

2. The band of claim 1, wherein:

the first structural member comprises a fabric, and the second structural member compresses the fabric.

3. The band of claim 1, wherein the second structural member expands from a first length to a second length based on the first force provided by the first structural member.

4. The band of claim 1, wherein:

the first structural member comprises a fabric, and the second structural member comprises an assembly, the assembly comprising a first metal structure and a second metal structure.

5. The band of claim 4, wherein:

the first end is configured to couple with a first receptacle of the wearable device; and the second end is configured to couple with a second receptacle of the wearable device, wherein the first metal structure is secured with the first end, and the second metal structure is secured with the second end.

6. The band of claim 5, wherein the first structural member extends continuously from the first end to the second end.

7. The band of claim 4, wherein the first metal structure overlaps the second metal structure.

8. The band of claim 1, wherein the second structural member is fixed to the first end, and the second dimension is less than the first dimension.

9. The band of claim 1, wherein the second force provides a counterforce that biases the first end and the second end toward the central portion.

10. A band for a wearable device, the band comprising:

a fabric cover that forms a first end and a second end opposite the first end;

a first spring element coupled with the first end; and a second spring element coupled with the second end, wherein the fabric cover pulls the first spring element and the second spring element in tension, and based on the first spring element and the second spring element being in tension, the first spring element and the second spring element are configured to apply a counterforce to compress the fabric cover from a first dimension to a second dimension.

11. The band of claim 10, wherein the fabric cover comprises a sleeve, and the first spring element and the second spring element are disposed in the sleeve.

12. The band of claim 10, wherein the first spring element overlaps with the second spring element.

13. The band of claim 10, wherein the first spring element and the second spring element are non-overlapping.

14. The band of claim 10, wherein:

when the first end is secured in a first receptacle of the wearable device, at least a portion of the first spring element is located in the first receptacle, and when the second end is secured in a second receptacle of the wearable device, at least a portion of the second spring element is located in the second receptacle.

15. A band for a wearable device, the band comprising:

an exterior structure that includes a sleeve, the exterior structure comprising a first end and a second end; and an interior structure disposed in the sleeve, the interior structure fixed to the first end, wherein in response to the first end and the second end being coupled with the wearable device, the interior structure applies a first force to compress the exterior structure from a first dimension to a second dimension less than the first dimension while the exterior structure applies a second force to pull the interior structure in tension.

16. The band of claim 15, wherein the interior structure comprises:

a first structural member that carries a first magnet and a second magnet; and a second structural member that carries a third magnet and a fourth magnet, wherein the first structural member and the second structural member are adjustable with respect to each other to transition between a first position and a second position.

17. The band of claim 16, wherein:

in the first position:

the first magnet is magnetically coupled to the third magnet, and the second magnet is magnetically coupled to the fourth magnet, and in the second position:

the first magnet is magnetically coupled to the fourth magnet, and the second magnet is magnetically coupled to the third magnet.

18. The band of claim 15, wherein the interior structure comprises:

a first structural member that carries a first detent and a second detent; and a second structural member that carries a first receptacle, a second receptacle, and a third receptacle, wherein the first structural member and the second structural member are adjustable with respect to each other to transition between a first position and a second position.

19. The band of claim 18, wherein:

in the first position:

the first detent is located in the first receptacle, and the second detent is located in the second receptacle, and in the second position:

the first detent is located in the second receptacle, and the second detent is located in the third receptacle.

20. The band of claim 15, wherein the exterior structure extends continuously from the first end to the second end.

* * * * *